United States Patent [19]

Chamberlin et al.

[11] Patent Number: 4,620,903

[45] Date of Patent: Nov. 4, 1986

[54] ELECTROFORMING PROCESS

[75] Inventors: Richard A. Chamberlin, 2107 Ebbesen Ave., San Jose, Calif. 95124; Mostafa Pournejat, San Jose, Calif.

[73] Assignee: Richard A. Chamberlin, San Jose, Calif.

[21] Appl. No.: 783,778

[22] Filed: Oct. 3, 1985

[51] Int. Cl.[4] ..... C25D 1/20

[52] U.S. Cl. ..... 204/4; 204/8

[58] Field of Search ..... 204/4, 6, 8

[56] References Cited

U.S. PATENT DOCUMENTS

| | | | |
|---|---|---|---|
| 497,303 | 5/1893 | Callow | 204/8 |
| 924,020 | 6/1909 | Walter | 204/8 |
| 2,172,563 | 9/1939 | Libberton | 204/8 |
| 2,874,085 | 2/1959 | Brietzke | 204/8 |
| 4,462,873 | 7/1984 | Watanabe | 204/4 |

*Primary Examiner*—T. M. Tufariello

*Attorney, Agent, or Firm*—Thomas E. Schatzel

[57] ABSTRACT

A method for producing highly detailed and multi-relief nameplates. A master image is produced by photoetching with a photopolymer. A negative production tool is formed from this master image, and comprises a plurality of individual nameplates formed in a sheet. The sheet is plated with a thin layer of nickel, and backfilled with a mixture of nylon and an epoxy resin, which is then cured to produce a solid mass. The obverses of the nameplates are chrome-plated and may be painted as desired. The reverse of the sheet is subjected to a cutting step using a fly cutting mill which separates the sheet by horizontally cutting raised edges between adjoining nameplates to produce a plurality of individual nameplates.

18 Claims, 6 Drawing Figures

ELECTROFORMING PROCESS

BACKGROUND OF INVENTION

1. Field of the Invention

This invention relates to an electroforming process and more particularly to an an electroforming process for producing high resolution, multi-relief, shell metal nameplates having a plastic filled reverse.

2. Description of the Prior Art

Numerous processes and methods of forming three-dimensional metallic designs, letters or nameplates are known and used in the art. Typically, such processes comprise the creation of a master image which may be by machining, or by various etching methods. From the master image, a production tool comprising a reverse, or negative, of the master, is formed by either a plating or casting process. This negative is then used in a plating operation whereby a metal, typically nickel or copper, is plated onto the negative. The plated material, when removed, forms the embossed nameplate or sign. Such processes are disclosed in U.S. Pat. Nos. 497,303 issued to Callow, 924,020 issued to Walter and 172,563 issued to Libberton. Other U.S. Patents which describe related methods include U.S. Pat. Nos. 2,874,085 issued to Brietzke, 3,574,074 issued to Eccles and 4,462,873 issued to Watanabe. The latter relates primarily to a method for arranging a plurality of separately electroformed letters to form a name and not to the method of producing the letters themselves.

A problem with prior art processes is that the known methods of creating a master image tend to lack sufficient detail for certain applications. Further, these processes generally do not provide for multi-relief capability, i.e., only one plane of detail is possible. Because such electroformed nameplates or designs are three-dimensional, a further problem occurs with strength and durability of nameplates fabricated with the techniques of the prior art. A nameplate fabricated of a very thin metal, for example, between five to fifteen thousandths of an inch, is not sufficiently rigid. Manufacturers may put an adhesive backing sheet behind the nameplate in an effort to add rigidity but such backings typically are of a compressible material and incompletely fill the cavity formed in the reverse of the nameplate by plating process. These backings also cannot fill the additional cavity caused by the raised lettering on the front of the plate. Alternatively, nameplates of the prior art may be formed of thicker metal, for example, between twenty to thirty thousandths of an inch or more. Such nameplates are rigid but are more costly as they require more metal and longer plating times, and are much heavier.

Accordingly, it is the object of the present invention to provide a method for the production of nameplates having a high degree of detail.

It is a further object of the present invention to provide a method for the production of multi-relief nameplates.

It is another object of the present invention to provide a method for the production of nameplates which does not require costly unique tooling.

It is another object of the present invention to provide a method for the production of nameplates which are rigid, strong, and light in weight.

It is a further object of the present invention to provide a method for the production of nameplates which are less expensive to manufacture.

It is another object of the present invention to provide a method for the production of nameplates which can be made in sheets and separated into individual nameplates by horizontal cutting rather than vertical punching, thus eliminating further exposed surfaces subsequent to cutting.

It is another object of the present invention to provide a method for the production of nameplates which does not result in misregistration during the cutting process.

Briefly, a preferred embodiment of the method of the present invention includes creating a master image by photoexposing and chemically etching a photopolymer. A production tool is made up and comprises the reverse of the master image repeated in rows and columns to form a sheet. This tool is plated with a metal such as nickel or copper to a thickness of between five to ten thousandths of an inch, and backfilled with a mixture of powdered nylon and an epoxy resin, to form a smooth, solid backing. The front surface of the sheet is chrome-plated and painted as desired. The sheet is separated into individual nameplates by a material removal means, e.g. a fly-cutting mill or a sander which horizontally severs the nameplates at their adjacent raised edges. The individual nameplates may then be provided with an adhesive backing or studs for mounting.

It is an advantage of the present invention that nameplates may be produced with a great degree of detail.

It is a further advantage of method of the present invention that multi-relief nameplates may be produced.

It is another advantage of the present invention that the nameplates are lightweight yet rigid and strong.

It is another advantage of the present invention that the nameplates are less costly to manufacture relative to their weight and durability.

It is another advantage of the present invention that costly unique tooling is eliminated and that high resolution nameplates can be produced more economically than with present methods.

It is another advantage of the present invention that individual nameplates are separated by horizontal cutting, thus eliminating misregistration and exposure of newly cut edges.

These and other objects and advantages of the present invention will no doubt become obvious to those of ordinary skill in the art after having read the following detailed description which is illustrated in the various drawing figures.

IN THE DRAWINGS

DETAILED DESCRIPTION OF THE PREFERRED EMBODIMENT

Figure 1:
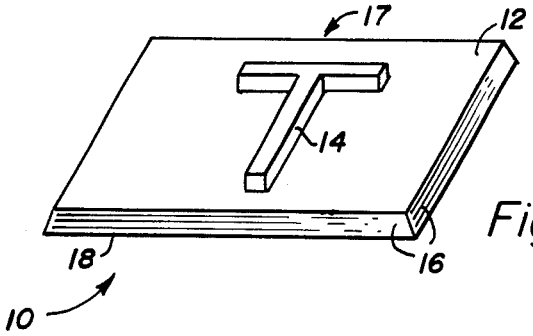
FIG. 1 is a perspective view of an obverse of a nameplate formed by the method of the present invention.

FIG. 1 illustrates a finished nameplate produced by the method of the present invention and referred to by the general reference character 10. As used herein, the term nameplate encompasses any three-dimensional decorative parts or metal panels, with or without words, symbols or designs, including, e.g. control panels having through-holes. The nameplate 10 includes a generally flat front surface 12, a raised or embossed portion 14 comprising letters or a design, and a plurality of sides 16 which may be angled slightly from the vertical such that the front surface 12 of the nameplate 10 has a slightly smaller perimeter than a reverse surface 18, shown also in FIG. 2. The surface 12, raised portion 14, and sides 16 all are formed of a thin layer of metal, such as nickel, copper or zinc, and comprise a shell 17. In the nameplate 10, the shell 17 is nickel. The reverse surface 18 is filled with a plastic material 20 which comprises a mixture of a polyamide and an epoxy resin. While several types of polyamides and resins may be used, in the nameplate 10 the polyamide is a powdered nylon, for example, that sold under the tradename Nylon 11. Other polyamides are also suitable, preferably thermosetting polyamides and include, e.g. Nylon 6, Nylon 66 and Nylon 12. The epoxy resin also preferably is a thermosetting resin and, for example, marketed under the tradename Shell 828. A small amount of a foaming agent may also be added to the plastic material 20 to promote the complete expansion thereof.

Figure 2:
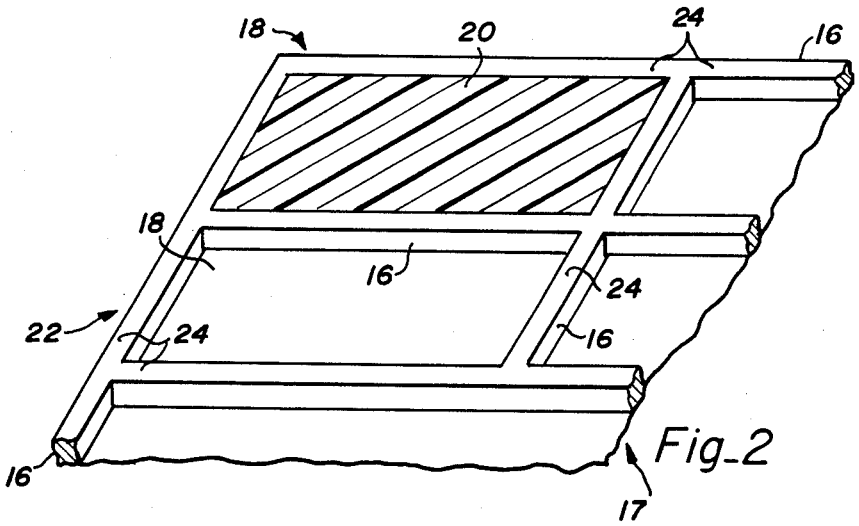
FIG. 2 is a perspective view of a reverse of a sheet of nameplates of FIG. 1.
Figure 3:
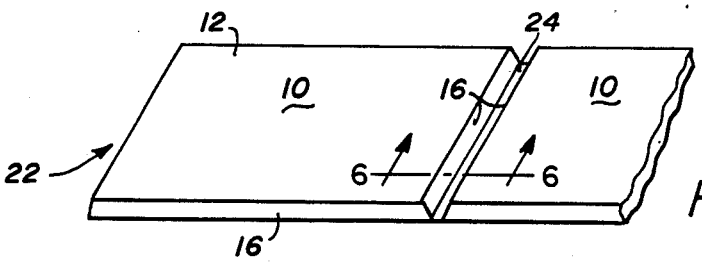
FIG. 3 is a perspective view of an obverse of a sheet of nameplates of FIG. 1.

FIGS. 2 and 3 illustrate the nameplates in a sheet 22 prior to their separation into individual nameplates 10. It can be seen from FIG. 2 that the reverse side of the sheet 22 includes a plurality of ridges 24 formed by adjacent sides 16 of adjoining nickel shells 17. FIG. 2 also illustrates the manner of filling the back of the sheet 22 with the plastic material 20. For clarity, only one filled nameplate is illustrated in FIG. 2. The plastic material 20 completely fills the reverse of the sheet 22 such that each reverse surface 18 is filled to be flush with the ridges 24, and a thin layer of plastic material 20 may cover the ridges 24 as well.

Figure 4:
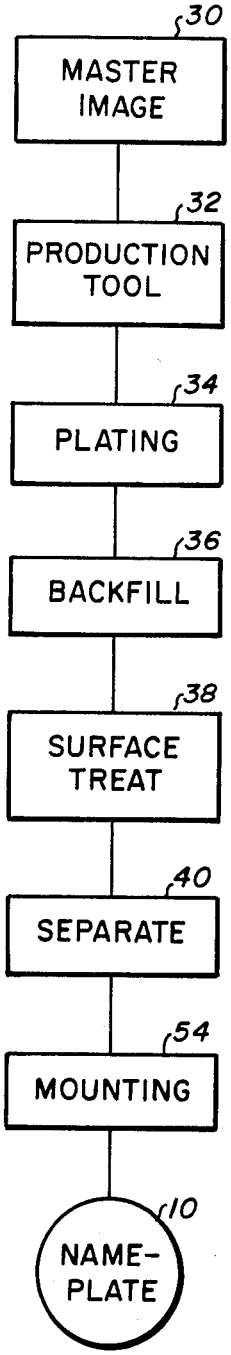
FIG. 4 is a flowchart diagram of the method of the present invention.

A schematic flowchart of the method of producing the nameplates 10 is illustrated in FIG. 4. The method begins with the production of a positive master image 30 which comprises photoexposing and chemically etching a liquid photopolymer. Solid photopolymers may also be used to create the master image but it has been found that the best results occur with the liquid. The master 30 is built up in layers to give multi-relief capability with very crisp detail. A negative image or mandrel is then made from the master 30 by conventional high resolution molding techniques. The mandrel is repeated and arranged in rows and columns to create a production tool 32 which typically fills a two-foot square sheet. The production tool 32 is put into a plating tank and nickel plated in a plating step 34 to result in the sheet 22 comprising a positive mandrel. The amount of nickel plated on the production tool 32 is between approximately five and ten thousandths of an inch.

A backfilling step 36 fills the nickel shells 17 with the plastic material 20. The nickel shells 17 are first given a chromate conversion treatment utilizing chromic and hydrochloric acids to promote bonding. The epoxy component of the plastic material 20 is sprayed on the reverse of the sheet 22 and the sheet 22 is filled with the Nylon 11, preferably in powder form.

After filling, the plastic material 20 is cured to a solid rigid mass by heating the sheets 22 in an oven at a temperature of approximately four hundred degrees fahrenheit (400° F.) for a period of between thirty to sixty minutes. Once the plastic material 20 has cured, the sheets 22 are removed from the oven, separated from the mandrel, and are given a finishing surface treatment 38. The treatment 38 may comprise a variety of painting, coating, buffing or silvering treatments of the prior art. The nameplates 10 are first coated with a thin layer of chromium, approximately three to five angstroms thick, for aesthetics and to provide added corrosion resistance. Colors may then be applied to the nameplates 10, generally by spraying the entire surface of the sheet 22 and wiping with a chemical, e.g. solvent, pad. This will result in paint remaining on the nonraised surface of the nameplate 10; i.e., the surface 12. If it is desired to coat the raised surface 14, a coating, e.g. paint, may be applied by roller or silkscreen, and this method may be either as an alternative to, or used in conjunction with, the spraying technique. Colors may also be applied selectively to designated portions of the nameplate 10. Lastly, the finishing treatment 38 may include a clear overcoat for durability and aesthetics.

Figure 6:
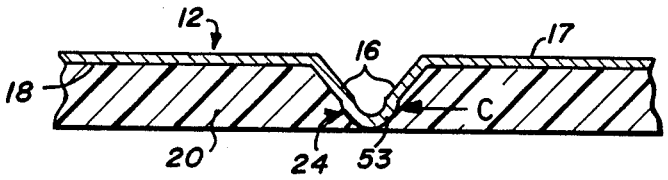
FIG. 6 is an enlarged side sectional view taken along line 6—6 of FIG. 3.
Figure 5:
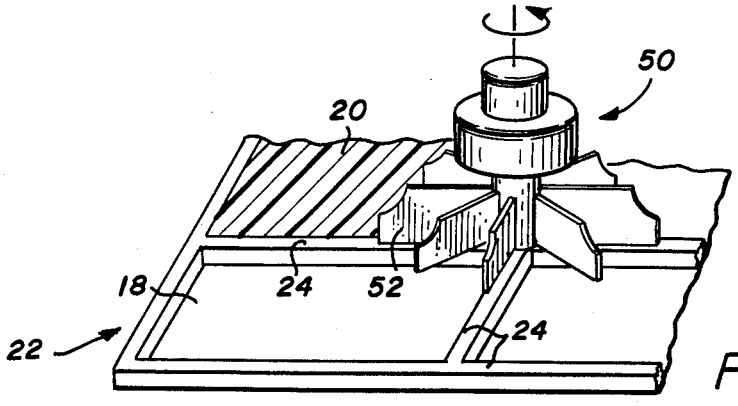
FIG. 5 illustrates a means for separating the individual nameplates from a sheet of FIG. 2.

Next is a separation step 40 to separate the sheet 22 into the individual nameplates 10. This is done by a removal means, for example, a fly cutting mill 50, schematically illustrated in FIG. 5. The fly cutting mill 50 utilizes a rotary cutting head 52 and horizontally cuts the ridges 24 of the sheet of nameplates 22. By cutting the ridges 24 rather than the sides 16, misregistration, common in prior art methods, is eliminated. FIG. 6 is an enlarged cross-sectional view of a metal ridge 24 between two nameplates of the sheet 22. The arrow "C" indicates the direction and placement of the cut produced by the fly cutting mill 50. The ridges 24 are actually cut about a "dead metal" area 53, as illustrated in FIG. 6. The dead metal area 53 comprises a substantially vertically-walled channel portion of the ridge 24, and is about twenty to thirty thousandths of an inch in depth. The dead metal area 53 allows for some variation in the vertical positioning of the cut without actually cutting the sides 16. This provides consistently precise perimeter dimensions of the finished nameplates 10. It can be seen that the cutting mill 50 will horizontally cut through the dead metal area 53 of the ridge 24 to free the individual nameplates 10. A portion of the backfilled plastic material 20 will also be removed by the mill 50 so that a flat, smooth reverse surface results.

Because the entire back surface of the sheet 22 is cut by the cutting mill 50, the back surface 18 of each nameplate 10 is smooth and uniform, which affords the nameplates 10 the maximum possible surface contact when mounted. The horizontal cut additionally does not expose a fresh surface which would ordinarily need to be repainted or retreated. Further, the separation method of the present invention allows for the production and separation of nameplates of any size and shape without special tooling, other than the master production tool, because separation is performed horizontally, rather than vertically.

In order to secure the sheet 22 during the cutting operation so that a uniform cut may be made across the entire surface of the sheet 22, the sheet 22 may be placed into a vacuum chuck (not shown) which is custom formed for the sheet 22 to have a plurality of rubberized chambers, equal in number, spacing and size to the nameplates on the sheet 22. The sheet 22 is placed into the vacuum chuck such that the front surfaces 12 of each nameplate mate with an individualized chamber of the vacuum chuck. Vacuum is applied to secure the sheet 22 to the vacuum chuck and the fly cutting head 52 is passed over the reverse surface of the sheet 22 to a depth sufficient to remove the ridges 24. It may be noted that other securing means are known, for example mechanical securing means, and may be equally well suited to the method of producing the nameplate 10.

Alternative materials removal means to remove the dead metal areas between the ridges 24 of the sheet 22 include an abrasive sanding means (not shown) such as a belt sander. The belt sander would be used analagously to the fly cutter 52 to abrasively remove plastic 20 and metal 24 until the nameplates were separated. Compared with the fly cutter 52, the belt sander requires a slightly greater degree of flatness on the master mold to originally produce the sheets 22, and an abrasive sander may produce a slightly rougher cut, will generate more heat, and may require multiple passes. The dead metal areas 53 may also be removed using a lapping process. Compared with milling or abrasive sandings, lapping requires less in the way of a securing means to secure the sheet 22 during the material removal process. Lapping also yields a very flat cut and generates very little heat. Other methods which can be employed to remove the dead metal areas 53 include chemical metal removal means and electrical discharge machining methods.

The final operation in the production of the nameplates 10 is a mounting step 54. Typically, this comprises securing an adhesive material (not shown) to the back of each nameplate 10. This may be done while the nameplates 10 are still held in the vacuum chuck; or after the cutting operation, it may be done to individual nameplates 10, or it may be omitted entirely. In the production of the nameplates 10, the mounting step 54 comprises applying a five mil adhesive on a release liner (not shown) to the individual nameplates 10 as they are held within the vacuum chuck. The adhesive sheet is then lifted off, carrying with it the plurality of nameplates 10. The nameplates are then simply separated from the adhesive sheet, with the result that each nameplate 10 carries its own adhesive pad. Alternatively, the mounting step 54 may comprise securing studs (not shown) to the plastic material 20. The studs may be secured by any means known in the art, e.g. adhesives, and are adapted for engaging apertures formed in the surface to which the nameplate 10 is mounted. The mounting studs may be used alone, or in conjunction with the adhesive backing.

It may be noted that while the method of the present invention has been described in terms of producing a sheet of nameplates 10, the initial steps of the invention are equally applicable to the production of a single nameplate, or a series of individual nameplates or designs. Furthermore, the latter steps of the method of the present invention, i.e., the metal separation technique, may also be used for other applications. For example, a series of three-dimensional metal shells 17 may be formed having adjacent ridges 24, wherein the shells 17 are intended for use as container or shielding means, and not as nameplates. Small, thin metal shells 17, having geometries which make them difficult to fabricate by many prior art methods are often used for shielding in electronics applications. The method of the present invention thus may be employed to produce sheets of the shells and then the separation may be effected as previously described.

Although described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A process for producing an electroformed nameplate from a positive master image comprising (a) producing a production tool comprising a negative image formed by electroplating a positive master image;

(b) plating said production tool with a layer of metal to form a positive mandrel comprising a single metal shell having a front surface image and a reverse surface forming a hollow cavity; and (c) backfilling said hollow cavity with a plastic material to fill said cavity to a level flush with the edges of the metal shell.

2. The method of claim 1 wherein the production tool is produced from a master image formed by photoexposing and chemically etching a photopolymer.

3. The method of claim 2 wherein said photopolymer is a liquid, and said master image is formed by pouring out a plurality of layers of said photopolymer whereby a multi-relief master image is formed.

4. The method of claim 1 wherein said production tool is repeated to form a production sheet, and said positive mandrel includes adjacent nameplates separated by a plurality of raised ridges on the reverse of said mandrel, each of said ridges including a vertically-walled dead metal portion; and said sheet of nameplates is separated into a plurality of individual nameplates by a material removal means whereby said raised ridges on the reverse surface are removed.

5. The method of claim 4 wherein said material removal means results in a horizontal cutting of said ridges about said dead metal area whereby a perimeter dimension of each of said nameplates is not affected by vertical placement of said material removal means.

6. A method of claim 4 wherein said material removal means is a fly cutting mill.

7. The method of claim 4 wherein said material removal means is an abrasive material removal means.

8. The method of claim 4 wherein said material removal means is a lapping machine.

9. The method of claim 1 wherein said positive mandrel is plated to a thickness of between five and ten thousandths of an inch with nickel metal.

10. The method of claim 1 wherein said plastic material comprises a mixture of a polyamide and an epoxy resin.

11. The method of claim 10 wherein said polyamide is Nylon 11 and said resin is a thermosetting resin; and said plastic material is cured by heating in an oven at a temperature of approximately four hundred degrees Fahrenheit (400° F.) for a period of beween thirty minutes and ninety minutes.

12. A process for producing a plurality of electroformed metal shells comprising:

(a) creating a positive master image of the desired shape;

(b) producing a production tool from the master, the production tool comprising a negative of the master and repeated to from a sheet of negatives;

(c) plating said production tool with a metal to form a sheet comprising a plurality of metal shells, each of said shells being attached to at least one other shell by a metal ridge portion of the sheet, and (d) separating said sheet into said plurality of individual shells by bringing said ridge portion of the sheet into contact with a material removal means whereby said ridges are removed and said shells are freed.

13. The process of claim 12 wherein said material removal means is a milling means.

14. A process for producing a plurality of electroformed nameplates comprising:

(a) producing a master image by photoexposing and chemically etching a liquid photopolymer;

(b) forming a production tool comprising a reverse of the master image repeated in rows and columns to form a sheet;

(c) plating the production tool with a layer of metal of about five and ten thousandths of an inch in thickness to form a positive mandrel comprising a single metal shell and having a raised front surface image and a reverse surface forming a hollow cavity, said cavity including a plurality of raised ridges formed by a plurality of sides of adjacent nameplates;

(d) backfilling said cavity with a plastic material comprising a mixture of a powdered nylon, an epoxy resin and a chromate conversion agent, said plastic material being filled to be flush with a level of said raised ridges;

(e) curing said plastic material by heating to a temperature of approximately four hundred degrees fahrenheit (400° F.) for a period of between approximately thirty and ninety minutes; and (f) separating said sheet into individual nameplates using a material removal means applied to remove plastic and metal from said reverse of the sheet in a horizontal plane, said plastic and metal being removed to a depth sufficient to eliminate said ridges, thereby freeing said individual nameplates.

15. An electroformed nameplate, comprising (a) a metal shell formed by producing a master image by chemically etching a photopolymer, using said master image to form a production tool comprising a reverse of said master and electroplating said reverse with metal of a thickness between five and ten thousandths of an inch, said metal shell having a front surface image and a reverse surface defining a hollow cavity; and (b) a plastic material comprising a mixture of a polyamide, an epoxy resin and a binding agent, backfilled on said reverse surface to form a smooth, rigid surface.

16. The nameplate of claim 15 wherein said metal is nickel, said polyamide is a nylon 11, and said epoxy resin is a thermosetting resin.

17. An electroformed nameplate, comprising (a) a metal shell formed by producing a master image by chemically etching a photopolymer, using said master to form a metal production tool comprising a reverse of said master repeated in rows and columns to form a sheet and electroplating said sheet with a layer of metal to a thickness of between five and ten thousandths of an inch, said sheet comprising a plurality of individual shells, each having a front surface image, a reverse surface defining a hollow cavity and a plurality of raised ridges between adjacent shells; and (b) a plastic material comprising a mixture of a polyamide and an epoxy resin backfilled on said reverse surface to form a smooth, rigid surface, and separating said backfilled shells into individual nameplates by passing a material removal means over said reverse to remove a portion of said raised ridges and plastic whereby said individual nameplates are freed.

18. The nameplate of claim 17 wherein said metal is nickel, said polyamide is a nylon 11 and said epoxy hardener is a thermosetting resin.

* * * * *